US010385628B2

(12) United States Patent
Colenutt

(10) Patent No.: US 10,385,628 B2
(45) Date of Patent: Aug. 20, 2019

(54) WEAR SLEEVE, AND METHOD OF USE, FOR A TUBING HANGER IN A PRODUCTION WELLHEAD ASSEMBLY

(71) Applicant: Colenutt Contracting Services Ltd., Whitecourt (CA)

(72) Inventor: Christopher Lee Colenutt, Whitecourt (CA)

(73) Assignee: Colenutt Contracting Services Ltd., Whitecourt (CA)

( * ) Notice: Subject to any disclaimer, the term of this patent is extended or adjusted under 35 U.S.C. 154(b) by 78 days.

(21) Appl. No.: 14/720,114

(22) Filed: May 22, 2015

(65) Prior Publication Data

US 2016/0340984 A1 Nov. 24, 2016

(51) Int. Cl.
*E21B 17/10* (2006.01)

(52) U.S. Cl.
CPC ..... *E21B 17/1085* (2013.01); *E21B 17/1007* (2013.01)

(58) Field of Classification Search
CPC ..... E21B 17/1085; E21B 17/1007
USPC ..... 166/378
See application file for complete search history.

(56) References Cited

U.S. PATENT DOCUMENTS

| | | | | |
|---|---|---|---|---|
| 520,716 | A | 5/1894 | Turton | |
| 2,124,840 | A | 7/1938 | Wrigley | |
| 2,272,022 | A * | 2/1942 | Roberts | E21B 33/04 277/329 |
| 2,628,112 | A | 2/1953 | Hebard | |
| 2,884,067 | A | 4/1959 | Marken | |
| 3,353,606 | A | 11/1967 | Dyer | |
| 4,613,140 | A | 9/1986 | Knox | |
| 5,025,864 | A | 6/1991 | Nobileau | |
| 5,199,495 | A | 4/1993 | Brammer | |
| 5,217,068 | A | 6/1993 | Newton | |
| 5,360,063 | A | 11/1994 | Henderson, Jr. | |
| 6,401,827 | B1 | 6/2002 | Ferguson | |
| 6,749,018 | B1 | 6/2004 | Ford | |
| 7,798,231 | B2 | 9/2010 | Ford | |

(Continued)

OTHER PUBLICATIONS

"API Tubing/Casing/Drilling Pipe Thread Protector for Oilfield," © 2014 Alibaba.com, <http://www.alibaba.com/product-detail/API-Tubing-Casing-Drilling-pipe-Thread_1605464595.html?s=p>, [retrieved Dec. 15, 2014], 7 pages.

(Continued)

*Primary Examiner* — Matthew R Buck
*Assistant Examiner* — Patrick F Lambe
(74) *Attorney, Agent, or Firm* — Christensen O'Connor Johnson Kindness, PLLC

(57) ABSTRACT

Wear sleeves and methods of using and installing such sleeves within a tubing hanger in a production wellhead assembly. A method includes positioning a wear sleeve around a polished rod and within a tubing hanger in a production wellhead assembly, the wear sleeve defining a production fluid passage. A wear sleeve includes an outer part with pin threading sized to fit uphole facing box threading in an internal bore of a tubing hanger; an inner part defining a polished rod passage, the inner part comprising sacrificial material; a keyway defined on an uphole facing surface of one or both the outer part and the inner part; and a production fluid passage defined in use by one or more of the outer part or the inner part.

20 Claims, 8 Drawing Sheets

(56) References Cited

U.S. PATENT DOCUMENTS

| | | | | |
|---|---|---|---|---|
| 8,333,237 | B2 | 12/2012 | Duhn | |
| 8,561,705 | B2 | 10/2013 | Wilson | |
| 2003/0205864 | A1* | 11/2003 | Dietle | F04B 39/04 277/434 |
| 2006/0032635 | A1* | 2/2006 | Rivard | E21B 43/126 166/287 |
| 2011/0232895 | A1 | 9/2011 | Klotz | |
| 2013/0213661 | A1 | 8/2013 | Reimert | |
| 2014/0034328 | A1 | 2/2014 | Smith | |

OTHER PUBLICATIONS

"API-6A Products Brochure," AES Valves Brochure, AES, Houston, Texas, published at least as early as Nov. 13, 2014, 36 pages.
PRO-D cross-section drawing, © 2015 Universal Tubi Protectors S.R.L., http://www.universaltubi.com/pdf/PRO-D.pdf>, published at least as early as Mar. 9, 2015, 1 page.
"PRO-D: Drill Pipe Thread Protectors," © 2015 Universal Tubi Protectors S.R.L., <http://www.universaltubi.com/prodotti/pro_d_drill_pipe_protectors.html>, [retrieved Mar. 9, 2015], 1 page.
Property comparison chart for Fluoropolymer and other plastics, published at least as early as Mar. 23, 2015, 1 page.
"Schlumberger Oilfield Glossary," Definition for Tubing Hanger, © 2015 Schlumberger Limited, <http://www.glossary.oilfield.slb.com/en/Terms.aspx?LookIn=term%20name&filter=tubing%20hanger>, [retrieved Mar. 5, 2015], 4 pages.
"Thread Protectors," DMR Oilfield Products Brochure, DMR, Edmonton, Alberta, Canada, published at least as early as Mar. 9, 2015, 2 pages.

* cited by examiner

WEAR SLEEVE, AND METHOD OF USE, FOR A TUBING HANGER IN A PRODUCTION WELLHEAD ASSEMBLY

BACKGROUND

Technical Field

This document discloses wear sleeves and methods of using and installing such sleeves within a tubing hanger in a production wellhead assembly.

Description of the Related Art

A production wellhead may include a reciprocating surface rod drive, such as a pump jack. The pump jack reciprocates a polished rod, which connects to a sucker rod, which connects to a bottom hole pump (BHP) to pump oil up the well. If the well bore deviates from vertical at or near the surface, the polished rod may be drawn to one side, potentially rubbing against components in the wellhead and scoring the polished rod. A scored rod may lead to fluid leakage through, and potential damage to, the seals on the stuffing box above the tubing hanger.

BRIEF SUMMARY

Disclosed herein are wear sleeves and methods of using and installing such sleeves within a tubing hanger in a production wellhead assembly.

In at least one embodiment, a method comprises positioning a wear sleeve around a polished rod and within a tubing hanger in a production wellhead assembly, the wear sleeve defining a production fluid passage.

In at least one embodiment, a wear sleeve comprises an outer part with pin threading sized to fit uphole facing box threading in an internal bore of a tubing hanger; an inner part defining a polished rod passage, the inner part comprising sacrificial material; a keyway defined on an uphole facing surface of one or both the outer part and the inner part; and a production fluid passage defined in use by one or more of the outer part or the inner part.

In at least one embodiment, a production wellhead assembly comprises a polished rod, a tubing hanger, and a wear sleeve positioned around the polished rod and within the tubing hanger.

At least one embodiment includes a method of producing oil through a production oil fluid passage defined by a wear sleeve positioned around a polished rod and positioned within a tubing hanger.

An insert for a retainer, such as an outer part, the retainer being threaded into uphole facing box threading in a tubing hanger, is disclosed. A kit of parts, for example an inner part and an outer part, or a series of inner parts, that make up a wear sleeve is disclosed. Wear sleeves are also disclosed for installation in a wellhead hanger or other suitable location in the production wellhead assembly. A polymeric polished rod bushing is disclosed for use in a production wellhead assembly.

In various embodiments, there may be included any one or more of the following features: Driving the polished rod with a reciprocating rod drive to produce oil through the production fluid passage. The wear sleeve comprising an outer part with pin threading sized to fit uphole facing box threading in an internal bore of the tubing hanger, and an inner part defining a polished rod passage, the inner part comprising sacrificial material. Positioning further comprises threading the outer part into the uphole facing box threading of the tubing hanger. The outer part is threaded into the uphole facing box threading of the tubing hanger, in which positioning further comprises inserting the inner part into the outer part. Inserting further comprises seating the outer part within an annular recessed portion defined on an outer surface of the inner part. Inserting further comprises translating a downhole end of the inner part past a downhole end of the outer part, the downhole end of the inner part comprising a plurality of collet fingers defining a downhole shoulder of the annular recessed portion. Positioning further comprises positioning the inner part of the wear sleeve on the polished rod, and inserting the inner part into the outer part of the wear sleeve. The production wellhead assembly comprises, in sequence in an uphole direction, the tubing hanger, a flow manifold, and a stuffing box, in which positioning further comprises removing the stuffing box from the flow manifold; disconnecting the polished rod from a sucker rod string and withdrawing the polished rod from the flow manifold; positioning the inner part of the wear sleeve on the polished rod; inserting the polished rod with the inner part of the wear sleeve into the flow manifold; inserting the inner part into the outer part of the wear sleeve; connecting the polished rod to the sucker rod string; and connecting the stuffing box to the flow manifold. A maximum outer diameter of the wear sleeve is defined by the pin threading of the outer part. The outer part comprises an outer sleeve, the inner part comprises an inner sleeve, and further comprising a lock for securing the inner sleeve within the outer sleeve. The inner sleeve comprises a downhole shoulder and an uphole shoulder spaced along an outer surface of the inner sleeve to define an annular recessed portion sized to seat the outer sleeve. The lock comprises a plurality of collet fingers that define the downhole shoulder. One or more of an uphole facing end surface of the downhole shoulder is beveled, and a downhole facing end surface of the outer sleeve is beveled. One or more of a downhole facing end surface of the downhole shoulder is beveled, and an uphole facing end surface of the outer sleeve is beveled. The production fluid passage comprises a plurality of grooves in an inner surface of the inner part from a downhole end to an uphole end of the inner part. The plurality of grooves comprises spiral grooves. The sacrificial material comprises Teflon. A wear indicator is also disclosed.

These and other aspects of the device and method are set out in the claims, which are incorporated here by reference.

BRIEF DESCRIPTION OF THE DRAWINGS

Embodiments will now be described with reference to the figures, in which like reference characters denote like elements, by way of example, and in which:

FIG. 10 includes dashed lines to illustrate a polished rod.

DETAILED DESCRIPTION

Immaterial modifications may be made to the embodiments described here without departing from what is covered by the claims.

In the life of an oil well there are several phases—drilling, completion, and production. Once a well has been drilled, it is completed to provide an interface with the reservoir rock and a tubular conduit for the well fluids. Well completion is a generic term used to describe the installation of tubulars and equipment required to enable safe and efficient production from an oil or gas well. The production phase occurs after successful completion, and involves producing hydrocarbons through the well from an oil or gas field.

Figure 4:
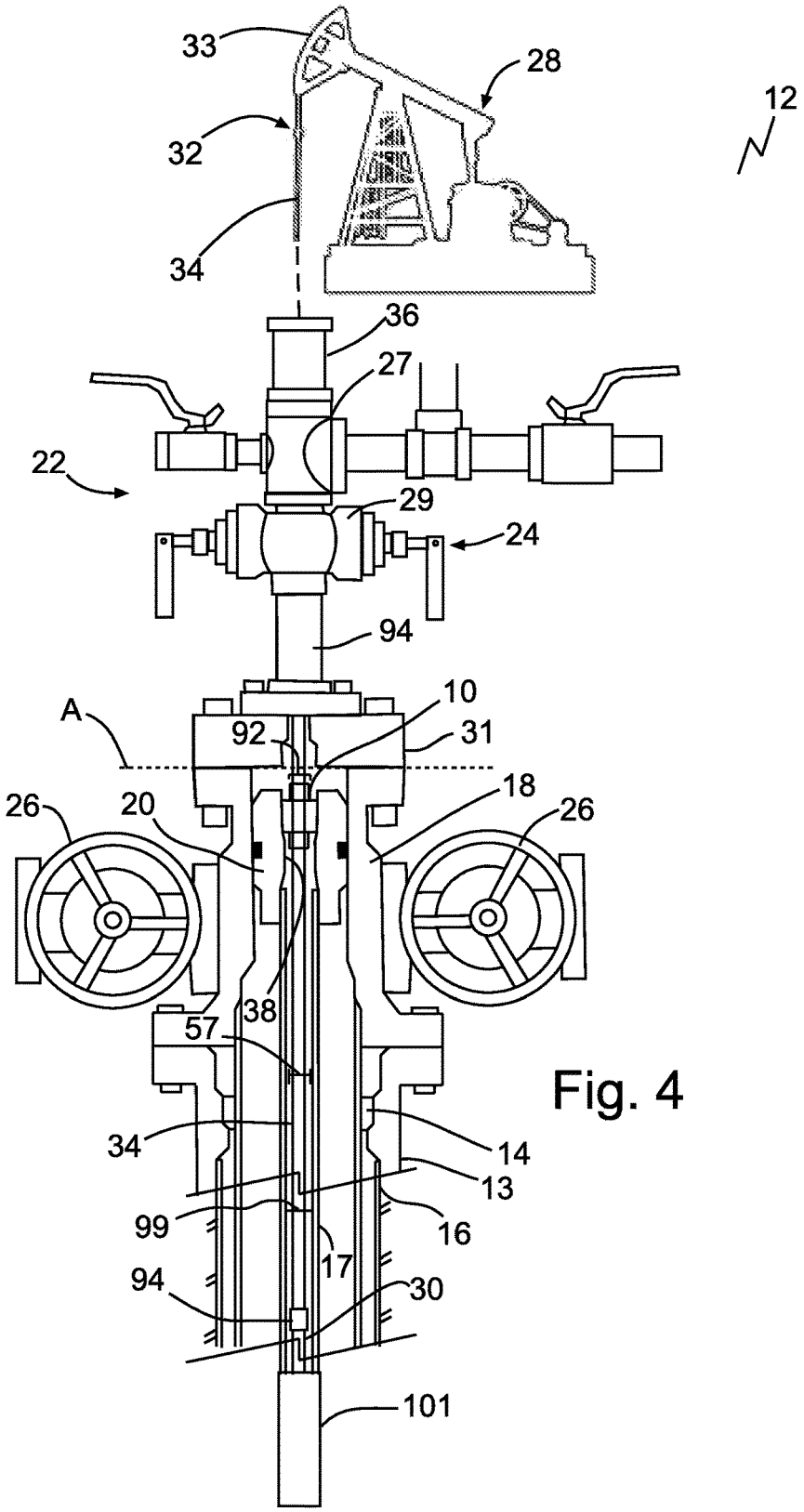
FIG. 4 is a side elevation view, partially in section, of a production wellhead with a wear sleeve positioned within the tubing hanger.
Figure 5:
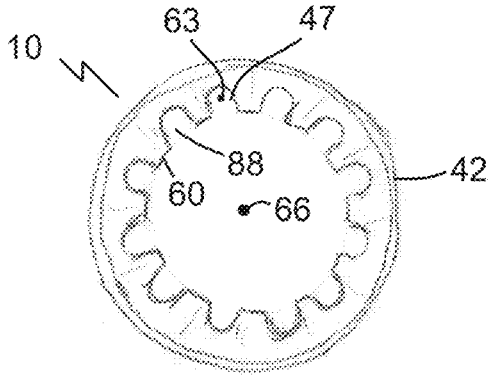
FIGS. 5 and 6 are an end elevation view, and a perspective view, respectively, of a further embodiment of an inner part of a wear sleeve.
Figure 7:
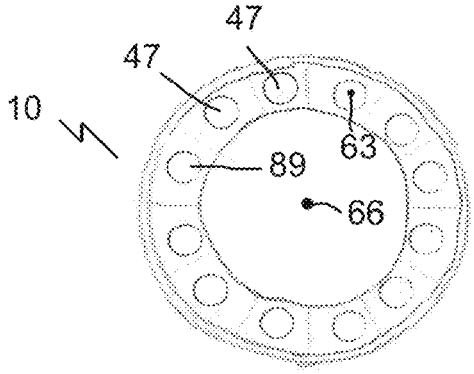
FIGS. 7 and 8 are an end elevation view, and a perspective view, respectively, of a further embodiment of an inner part of a wear sleeve.
Figure 6:
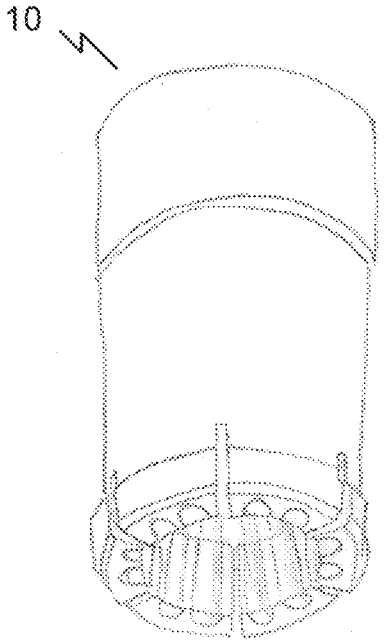
Figure 8:
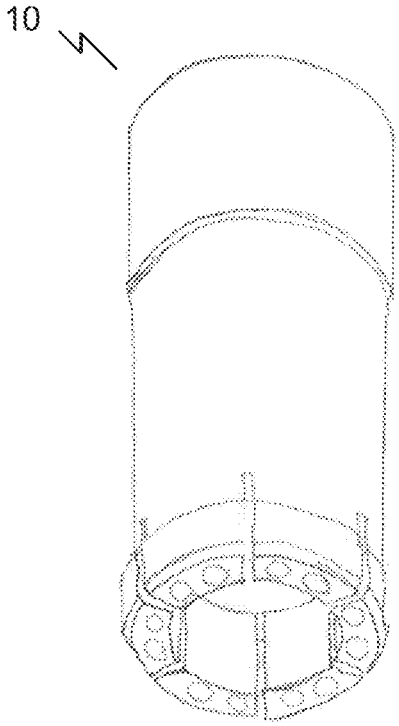

Referring to FIG. 4, a production wellhead assembly 12 is illustrated. The assembly 12 is an assembly of components that form the surface termination of a wellbore and includes various production equipment at the surface. A production wellhead assembly may include spools, valves, manifolds, and assorted adapters that provide pressure control of a production well.

The assembly 12 may incorporate components, such as a casing bowl or spool 13, for internally mounting a casing hanger 14 during the well construction phase. The casing hanger 14 suspends a casing string 16, which may be steel pipe cemented in place during the construction process to stabilize the wellbore. The wellhead or bowl 13 may be welded onto the outer string of casing, which has been cemented in place during drilling operations, to form an integral structure of the well.

The assembly 12 may include surface flow-control components, such as the group of components that are sometimes collectively referred to as a Christmas tree 22. The Christmas tree 22 may installed on top of the casing spool 13, for example with isolation valves 24, and choke equipment such as production valves 26 to control the flow of well fluids during production. Other components such as a flow manifold 27, also known as a flow tee, a bonnet 94 and a rod blowout preventer (BOP) 29 may be provided as part of the production wellhead assembly 12. Manifold 27, bonnet 94, and BOP 29 may be mounted on a spool 31 mounted on the tubing head 18. The flow manifold 27 may direct produced fluids to processing or storage equipment, such as a surface production tank.

The production wellhead assembly 12 also incorporates a means of hanging production tubing 17. For example, the assembly 12 may include a tubing head 18 mounted on the casing spool 13, the tubing head 18 internally mounting a tubing hanger 20. A tubing hanger 20 is a component used in the completion of oil and gas production wells. It may be set in the Christmas tree 22 or the wellhead and suspends the production tubing 17 and/or casing. Sometimes the tubing hanger 20 provides porting to allow the communication of hydraulic, electric and other downhole functions, as well as chemical injection. The tubing hanger 20 may also serve to isolate the annulus and production areas. The production tubing 17 runs the length of the well to a bottom hole pump (BHP), and serves to isolate the tubing interior from the annulus for production up the interior of the tubing 17.

A production wellhead assembly 12 may connect to or house part of an artificial lift system such as a reciprocating rod pump or drive. An artificial lift is a system that adds energy to the fluid column in a wellbore with the objective of initiating and improving production from the well. Artificial lift systems use a range of operating principles, including rod pumping, gas lift and electric submersible pump. A reciprocating rod drive, such as a pump jack 28, is an artificial lift pumping system that uses a surface power source to drive a BHP assembly (not shown). A beam and crank assembly in the pump jack 28 converts energy, for example in the form of rotary motion from a prime mover, into a reciprocating motion in a sucker-rod string 30 that connects to a BHP assembly. The BHP may contain a plunger and valve assembly to convert the reciprocating motion to vertical fluid movement.

A pump jack 28 is also known as an oil horse, donkey pumper, nodding donkey, pumping unit, horsehead pump, rocking horse, beam pump, dinosaur, grasshopper pump, Big Texan, thirsty bird, or jack pump in some cases. A pump jack or other artificial lift system may be used to mechanically lift liquid out of the well when there is not enough bottom hole pressure for the liquid to flow all the way to the surface. Pump jacks are commonly used for onshore wells producing little oil.

A reciprocating rod drive such as a pump jack 28 connects via a bridle 32 to a piston known as a polished rod 34 that passes through a stuffing box 36 to enter the wellbore. The polished rod 34 is the uppermost joint in the sucker rod string 30 used in a rod pump artificial-lift system. The polished rod 34 enables an efficient hydraulic seal to be made by the stuffing box 36 around the reciprocating rod string. Thus, the polished rod 34 is able to move in and out of the stuffing box without production fluid leakage. The bridle 32 follows the curve of the horse head 33 as it lowers and raises to create a nearly vertical stroke. The polished rod 34 is connected to a long string 30 of rods called sucker rods, which run through the tubing 17 to the down-hole pump 101, usually positioned near the bottom of the well.

The successful operation of the polished rod requires a tight seal between the polished rod 34 and the seals (not shown) of the stuffing box 36. If the polished rod 34 becomes damaged, for example scored, the rod 34 must be replaced before damage is done to the stuffing box 36. In some cases, the seals also must be replaced. Damage to the polished rod 34 may be caused from continued contact with internal components of the production wellhead assembly 12.

In a perfectly vertical well, and even a well nominally deviated from vertical near the surface, the polished rod 34 reciprocates without contacting anything but the stuffing box seals. However, in some wells that deviate from true vertical measured with respect to the surface of the earth, the rod 34 may be drawn to one side where contact can occur. Deviation is less of a concern the further from the surface the deviation is, but in many cases such deviation occurs before the first rod centralizer on the sucker rod string 30. In deviation situations, contact often occurs with the interior bore 38 of the tubing hanger 20.

A fluid leak may be caused if damage is done to the rod 34, such leak leading to potential environmental damage and cleanup cost. Production wellheads are often unmanned and in remote areas in many cases, and thus, even a relatively small fluid leak carries a potential for devastation because the leak may go unnoticed for days and sometimes weeks. Replacing the rod 34 requires a well service entity to kill the well, lift the damaged rod 34 out of the well, connect a new polished rod 34 to the sucker rod string 30, and repair any damaged seals in the stuffing box 36 before connecting the new rod 34 to the pump jack 28.

In many cases, the new rod 34 will itself become damaged in a short period of time, because the underlying cause of the damage still exists, namely the deviated well. Often the use of roller guides or centralizers on the rod 34 are unsuccessful in preventing further damage. Roller guides and centralizers merely ride along the polished rod 34 below the tubing hanger 20, and thus have a minimal corrective effect when the rod 34 is at or near a bottom position in a stroke cycle.

Figure 1:
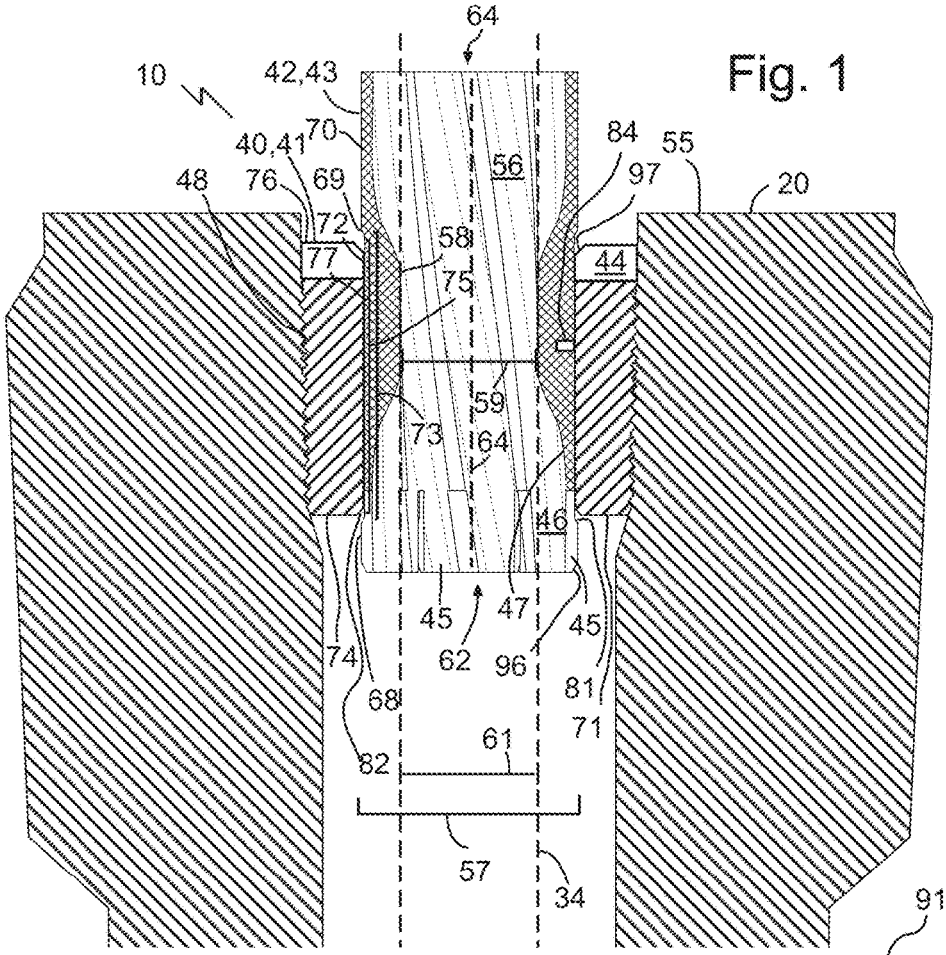
FIG. 1 is a side elevation section view of a wear sleeve positioned within a tubing hanger, with a polished rod illustrated in dashed lines.

Referring to FIGS. 1 and 4, a production wellhead assembly 12 is illustrated comprising a polished rod 34, a tubing hanger 20, and a wear sleeve 10 positioned around the polished rod 34 and within the tubing hanger 20. Referring to FIGS. 1-3 and 1A, wear sleeve 10 may comprise an outer part 40, an inner part 42, a keyway 44, and a production fluid passage 46. In the example shown, the outer part 40 comprises an outer sleeve 41 and the inner part 42 comprises an inner sleeve 43. The inner sleeve 43 nests concentrically within the outer sleeve 41 during operation in the example shown. A lock, such as collet fingers 45 on inner part 42, described further in this document, may be provided for securing the inner sleeve 43 within the outer sleeve 41.

Figure 1A:
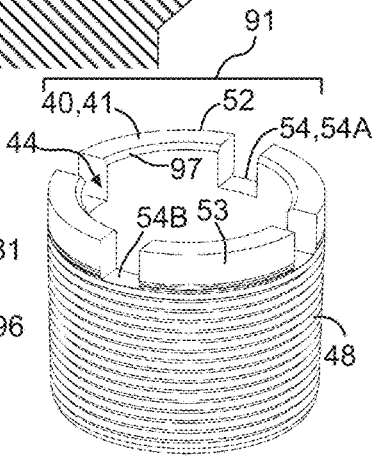
FIG. 1A is a perspective view of an outer part used in the wear sleeve of FIG. 1.

Referring to FIGS. 1 and 1A, the outer part 40 has pin threading 48 sized to fit uphole facing box threading 50 in internal bore 38 of tubing hanger 20. The internal bore 38 of tubing hanger 20 provides a passage for the polished rod 34 in use, and is sized to provide sufficient clearance between the rod 34 and hanger 20 to permit room for production fluids to pass up towards the flow manifold 27. In use, the rod 34 and internal bore 38 define an annulus 39 in which the wear sleeve 10 is positioned. The uphole facing box threading 50 in internal bore 38 is normally used to connect to a running tool (not shown) for the purpose of running the tubing hanger 20 into position in the tubing head 18.

The keyway 44 may be defined on an uphole facing surface 52 of one or both the outer part and the inner part, in this case the outer part 40. The keyway 44 may comprise a series of recesses 54 radially spaced about uphole facing surface 52, which has a ring shape in the example. The uphole facing surface 52 may be collectively defined by projections 53 radially spaced and extended in an uphole direction from the pin threading 48, with gaps between the projections 53 defining the recesses 54. The keyway 44 permits a key, such as a flat plate or bar (not shown), for example sized to span cooperating recesses 54A and 54B on opposite sides of the outer part 40, to engage keyway 44 to transmit torque to the outer part 40 for the purpose of threading or unthreading the outer part 40 into the tubing hanger 20.

In one example, a paint mixing attachment for a handheld drill may be used as a suitable key. In another, a semi cylinder made up of a pipe cut lengthwise in half may be used as a suitable key, with or without projections at one end spaced to connect to two or more recesses 54. Loctite, sealing tape, torque rings, or other mechanisms may be used to secure the outer part 40 within the box threading 50 in use. The keyway may comprise a suitable shape, such as a slot, ridge, or hole.

Figure 2:
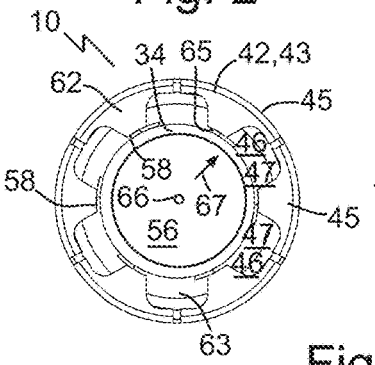
FIG. 2 is an end elevation view of the collet end of an inner part of the wear sleeve of FIG. 1, positioned around a polished rod.
Figure 3:
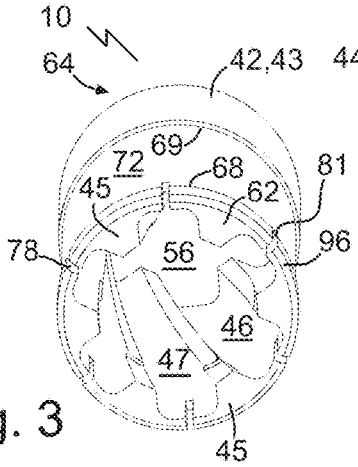
FIG. 3 is a perspective end view of the inner part of FIG. 2.
Figure 10:
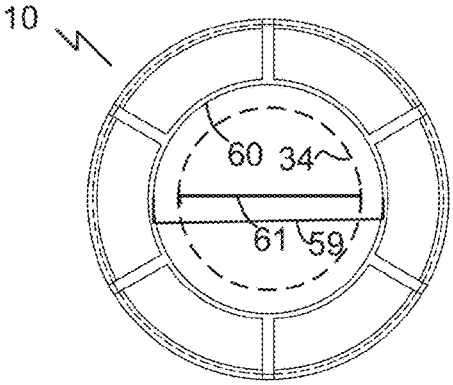
FIGS. 10-12 are an end elevation view, a side elevation section view, and a perspective view, respectively, of a further embodiment of an inner part of a wear sleeve.

Referring to FIGS. 1-3, the inner part 42 defines a polished rod passage or passages 56. The polished rod passage 56 must be sized sufficient to permit the polished rod 34 to pass as well as permitting the polished rod to reciprocate within the passage 56. Referring to FIG. 2, polished rod passage 56 may be defined by a series of radially spaced inner fins or ridges 58 about the interior of the inner part 42. In other cases, the polished rod passage 56 may be defined by a cylindrical inner bore 60 of the wear sleeve 10 (FIG. 10). Referring to FIG. 1, the inner ridges 58 collectively define a passage with an ID 59 equivalent or larger than the outer diameter (OD) 61 of the polished rod 34. Referring to FIG. 2, ridges 58 may be curved to follow the contour of the circumference of polished rod 34.

Referring to FIGS. 1 and 2, production fluid passage or passages 46 may be defined in use by one or more of the outer part 40 or the inner part 42, in this case the inner part 42. The production fluid passages 46 may comprise a plurality of grooves 47 in an inner surface, which for example is made up of ridges 58, of the inner part 42. The grooves 47 may extend from a downhole end 62 to an uphole end 64 of the inner part 42. Thus, in use, production fluids are pumped up the tubing 17 (FIG. 4) through the production fluid passages 46 (FIG. 1), and into the flow manifold 27.

Referring to FIGS. 1 and 2, the plurality of grooves 47 may comprise spiral grooves as shown. Referring to FIGS. 1-3, spiral grooves 47 may be defined such that a groove axis 63 (FIG. 2) rotates partially around a wear sleeve axis 66 (concentric with and equivalent in use to a tubing hanger axis) in a direction from the downhole end 62 to the uphole end 64. The rotation may only be a fraction of a radian, for example a sixty degree shift, or may be more substantial, for example a radian, full circumferential rotation or more. A sufficiently small angle of shift, such as sixty degrees, may be used so that regardless of deviation direction, the rod always touches a plurality of fins 58.

Referring to FIGS. 1 and 2, spiral flutes or grooves 47 produce spiral ridges 58, which, when viewed down the axis 66 (FIG. 2) provide continuous circumferential contact about the polished rod 34. Thus, regardless of the direction of well deviation 67, at some point along the axis 66 the polished rod 34 will be in contact with a plurality of ridges 58 as well as the center 65 of a plurality of ridges 58. Grooves 47 maximize the contact area with the polished rod 34.

The inner part 42 may comprise sacrificial material, such as TEFLON™. TEFLON™ includes polytetrafluoroethylene (PTFE), a synthetic fluoropolymer of tetrafluoroethylene. In one case, the outer part 40 comprises sacrificial material as well, and in further cases the entire wear sleeve 10 is made of sacrificial material. A suitable sacrificial material may be used that wears on contact with the polished rod 34 without wearing the surface of the polished rod 34. Other sacrificial materials may be used, such as other polymers, fluoropolymers, plastics, nylon, rubber, urethane, fabric, graphite, nylon, and in some cases metals, such as brass, that are softer than the material of the polished rod. In one example the sacrificial material comprises ethylene tetrafluoroethylene (ETFE), which is a fluorine based plastic designed to have high corrosion resistance and strength over a wide temperature range. ETFE is also known as poly (ethene-co-tetrafluoroethene).

The material of the wear sleeve 10 may comprise material that is resistant to chemicals such as acid, well treatment fluids, and downhole fluids. The material of the wear sleeve 10 may also be resistant to high temperature fluids such as steam periodically used in well treatments. In some cases a lubricant is provided on the inner bore 60 (FIG. 10) or ridges 58 (FIG. 2) to lubricate between the wear sleeve 10 and the polished rod 34, but oil in the production fluids may achieve the same effect. The material may also be resistant to abrasion from sand and other abrasives potentially found in production fluids.

Referring to FIGS. 1 and 3, the inner sleeve 42 may comprise a downhole shoulder 68 and an uphole shoulder 69 spaced along an outer surface 70 of the inner sleeve 42. The shoulders 68 and 69 may define an annular recessed portion 72 sized to seat the outer sleeve 40. The downhole shoulder 68 may be uphole facing, and the uphole shoulder 69 may be downhole facing. Referring to FIG. 1, the shoulders 68 and 69 may be separated a distance 73 equal or larger than a length 75 between downhole and uphole shoulders 74 and 76 separated by an inner surface 77 of the outer part 40. Shoulders 74 and 76 may comprise ends of the outer part 40 as shown.

Referring to FIGS. 1 and 3, as described elsewhere in this document, collet fingers 45 may provide a lock for securing the inner sleeve 43 within the outer sleeve 41. Collet fingers 45 may comprise projections radially spaced about axis 66 and separated by gaps 78 (FIG. 3). Collet fingers 45 may define the downhole shoulder 68. Gaps 78 may extend from downhole end 62 and partially into the annular recessed portion 72. Referring to FIG. 1, to install the guide sleeve 42 in the outer part 40, the downhole end 62 of the inner part 42 may be translated past a downhole end 71 of the outer part 40. The downhole end 62 may be inserted into the outer part 40 in a downhole direction.

Referring to FIG. 1, during installation, the downhole end 62 of fingers 45 contacts uphole shoulder 76, which may also define an uphole end 79, of outer part 40. The contact acts to apply radially inward pressure on collet fingers 45, causing the fingers 45 to move from a neutral position into a radially compressed position to allow downhole end 62 to fit within, and continue translation through, the outer part 40. Once the downhole shoulder 68 of the inner part 42 clears the downhole shoulder 68 of the outer part 40, the pressure on collet fingers 45 is removed, allowing the fingers 45 to move radially outwards back into the neutral position. The outer part 40 is now seated within the annular recessed portion 72, to prevent relative movement between the outer and inner parts 40, 42 during production and reciprocation of the polished rod 34.

Collet fingers 45 are one example of a lock, and other suitable locks may be used. For example, latch, magnet, strap, adhesive, dog, friction fit, pressure lock, twist lock, tongue and groove, pin and hole, pin and slot, and other suitable locks may be used. In one example, the collet fingers 45 may be positioned at either the downhole end 62, the uphole end 64, or both.

Referring to FIGS. 1, 1A, and 3, portions of the outer and inner parts 40, 42, of the wear sleeve 10 may be beveled, for example to facilitate insertion, removal, or both insertion and removal of the inner part 42. Referring to FIGS. 1 and 3, an uphole facing end surface 81 of the downhole shoulder 68 may be beveled. Referring to FIGS. 1 and 1A, a downhole facing end surface 82 of the outer part 40 may be beveled. Referring to FIG. 1, when it is desired to remove the inner part 42 from the outer part 40, beveling of end surfaces 81 and 82 may again act to wedge the inner part 42 within the outer part 40, by converting some of the axial translation force that is oriented in an uphole direction into radially inward force during retrieval. In some cases, beveling of one or more of downhole facing end surfaces 96 and uphole facing surfaces 97 of the downhole shoulder 68 and outer part 40, respectively, may act to wedge the inner part 42 within the outer part 40, by converting some of the axial translation force that is oriented in a downhole direction into radially inward force during insertion.

A bevel may refer to the fact that the end surface is sloped, curved, or both sloped and curved such that a plane defined by a portion of the end surface forms an obtuse angle with the axis 66, in order to produce a wedging effect. A bevel may be used instead of a ninety degree edge between components. The uphole shoulder 69 and uphole end 79 may also be selectively beveled. The structure and shape of the end surfaces may be selected to permit wedging to occur only upon application of a force above a selected threshold force, which is greater than the axial force exerted upon the wear sleeve by the polished rod 34 during use. Thus, the inner part 42 may remain stationary within the outer part 40 during pumping of production fluids, but still be able to be easily removed upon application of axial translation force.

Referring to FIG. 1, the wear sleeve 10 may comprise a wear indicator 84. The wear indicator 84 may be adapted to alert the well operator to a worn condition of the wear sleeve 10, for example a worn condition of the inner part 42. The worn condition may be selected as a fail, near fail, or partially worn condition of the inner part 42, a fail corresponding to a penetration of the polished rod 34 into contact with the outer part 40. The wear indicator 84 may be spaced from inner bore 60 a selected distance corresponding to a proportion of wear required on the inner part 42 before contacting the wear indicator 84. Thus, a wear indicator inset 50% of the width of the inner part 42 may become active when the inner part 42 is 50% worn.

The wear indicator may comprise a dye selected to stain the polished rod such that a stained portion of polished rod is visible when the stained or discolored portion is drawn out of the stuffing box 36 during a stroke cycle. The dye may be selected to be removable upon cleaning the polished rod and replacing the inner part 42.

Another example of a wear indicator 84 is a series of screws, for example brass screws, laterally inset within the inner part 42 around the axis 66. Brass is a softer material than the polished rod 34, and thus contact with the polished rod 34 will result in deposition of brass upon the polished rod 34, in a manner that will be visible to the well operator. Brass is suitable because if the screws fall down the well such screws will not interfere with downhole operations. Other wear indicators 84 may be used, for example incorporating an alarm, a sensor, a sight glass, and a rod marker may be used. In one example, the wear indicator 84 may be selected to lightly score the polished rod 34 in a manner that does not affect stuffing box operation.

Referring to FIG. 1A, a maximum outer diameter 91 of the wear sleeve 10 may be defined by the pin threading 48 of the outer part 40. In such a case, the projections 53 extended in an uphole direction relative to the pin threading 48 may collectively define an equal or smaller OD than the maximum OD 91 of the pin threading 48. The uphole facing surface 52 may be situated in a downhole direction from an uphole end 55 of the tubing hanger 20 as shown in FIG. 1.

Figure 9:
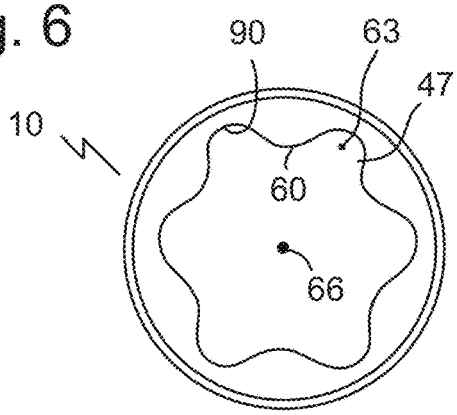
FIG. 9 is an end elevation view of a further embodiment of an inner part of a wear sleeve.

Referring to FIGS. 5-6, 7-8, and 9, three further embodiments, respectively, of an inner part 42 suitable for use in outer part 40 of FIG. 1A is illustrated. In each embodiment, the inner part 42 is shown with a plurality of grooves or notches 47 structured such that the groove axes 63 are parallel to the sleeve axis 66 across the axial length of the sleeve 10. All three embodiments also illustrate different groove 47 shapes that may be used, from archways or half-rounds 88 (FIG. 6) notched into the inner bore 60, to cylindrical conduits 89 (FIG. 8) to troughs 90 in a wave shaped inner bore 60 (FIG. 9). A groove axis 63 may be defined as the center of cross-sectional area within a groove 47. Other suitable production fluid passages 46 may be used.

Figure 11:
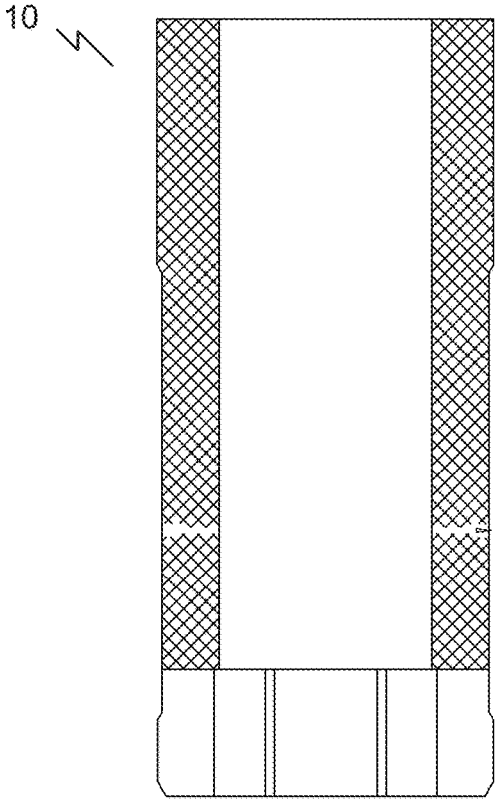
Figure 12:
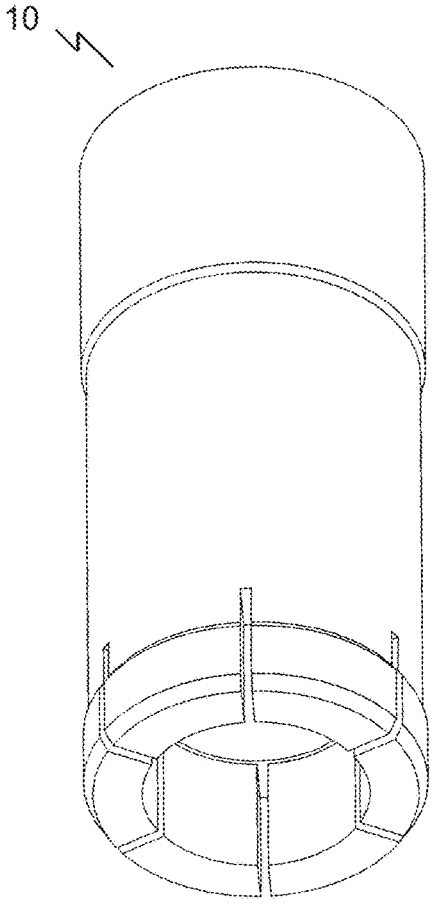
Figure 13:
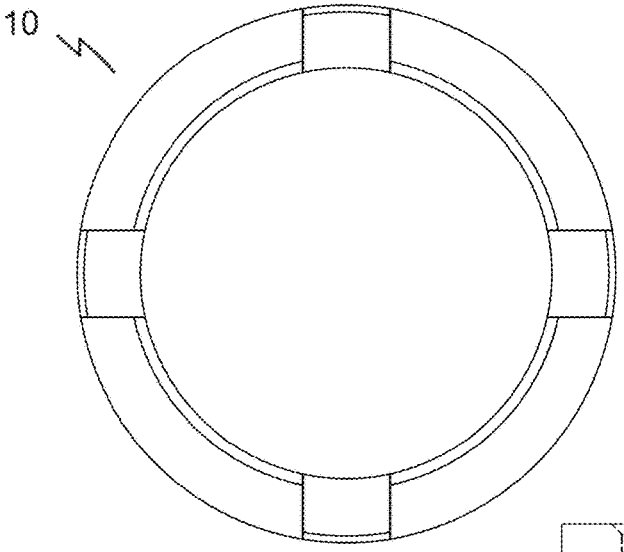
FIGS. 13-15 are an end elevation view, a side elevation section view, partially in section, and a perspective view, respectively, of a further embodiment of a wear sleeve.
Figure 14:
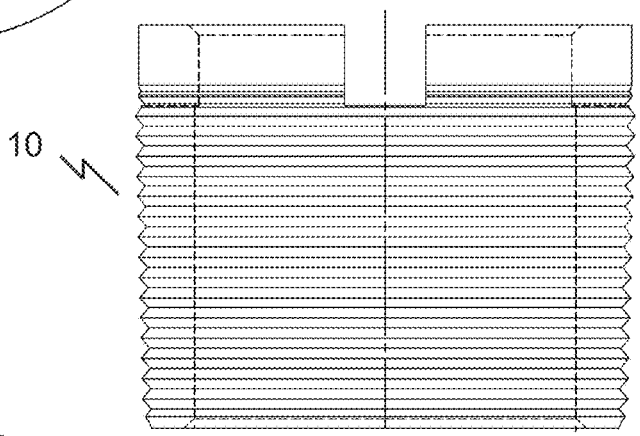
Figure 15:
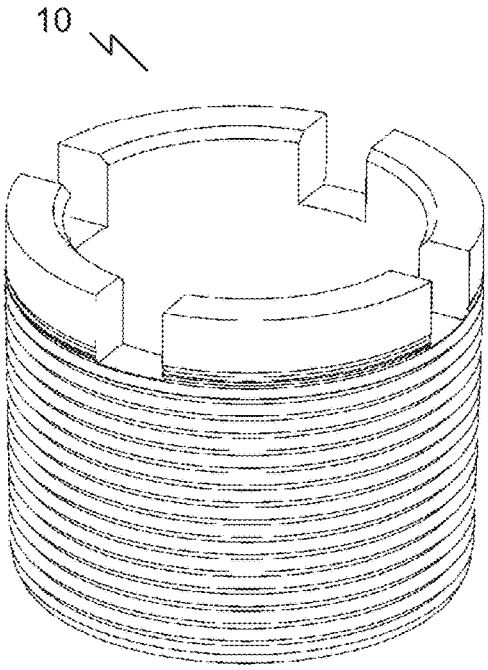
Figure 16:
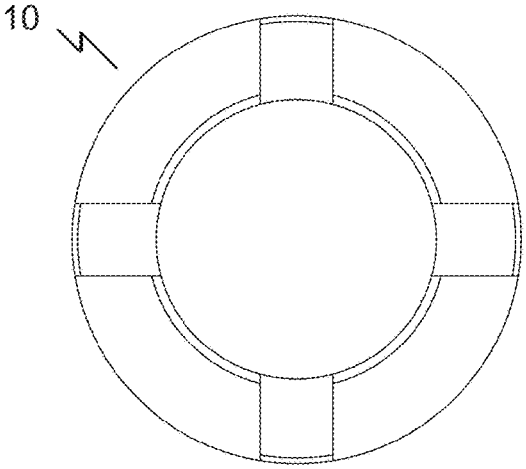
FIGS. 16-18 are an end elevation view, a side elevation section view, partially in section, and a perspective view, respectively, of a further embodiment of a wear sleeve.
Figure 17:
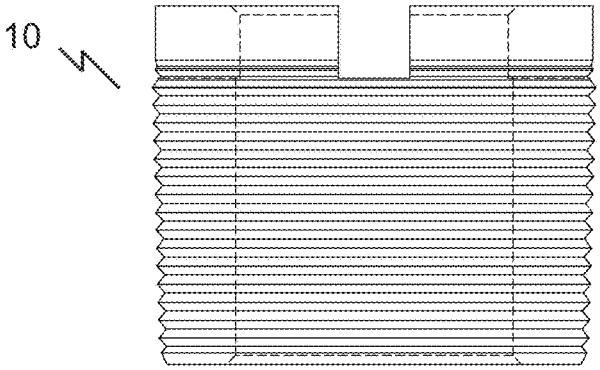
Figure 18:
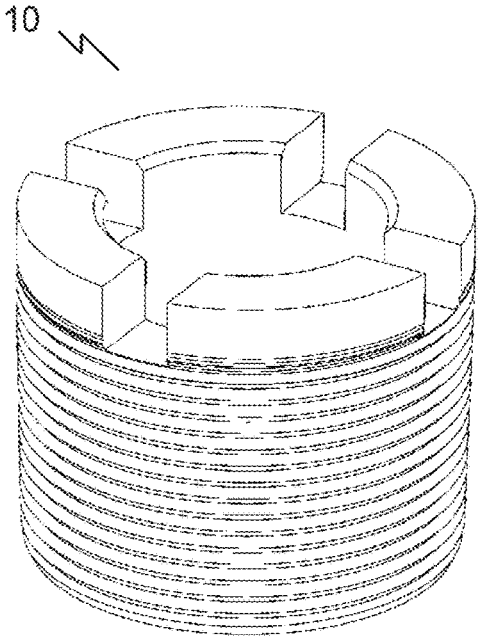
Figure 19:
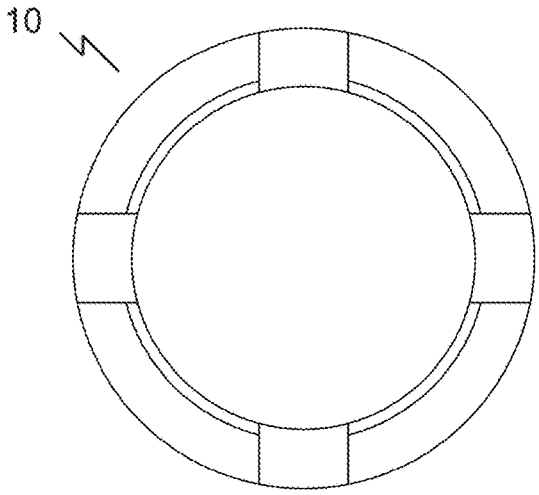
FIGS. 19-21 are an end elevation view, a side elevation section view, and a perspective view, respectively, of a further embodiment of a wear sleeve.
Figure 20:
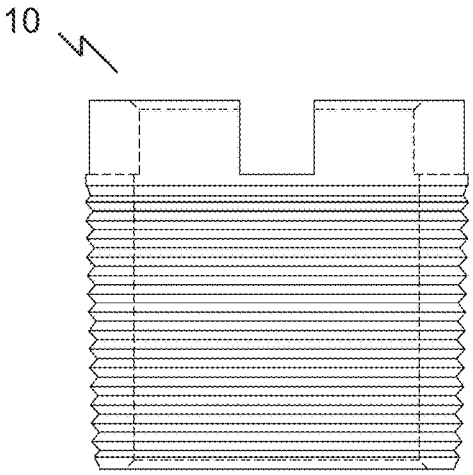
Figure 21:
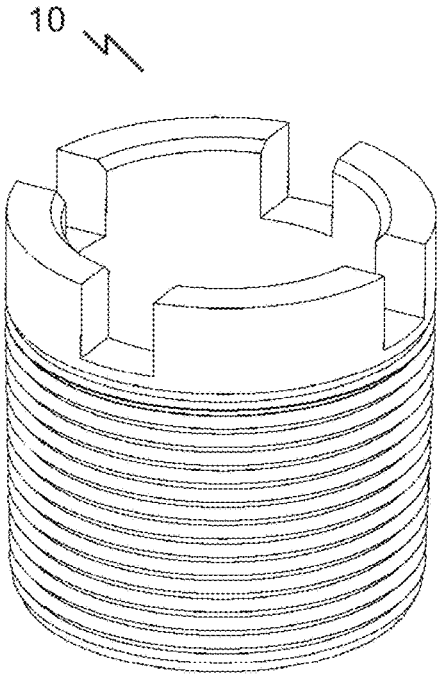

Referring to FIGS. 10-12, a further embodiment of an inner part 42 suitable for use in outer part 40 of FIG. 1A is illustrated. In the example shown, the production fluid passage 46 is defined by a cylindrical inner bore 60 being sized with an ID 59 sufficiently larger than an OD 61 of the polished rod 34, to permit production fluid flow across wear sleeve 10 in a sufficiently unrestricted manner.

The ID 57 (FIG. 1) of outer part 40 may be smaller than the nominal ID 99 (FIG. 4) of the tubing 17. The use of wear sleeve 10 reduces the internal cross sectional area available to permit tools and production fluid to pass, than if no wear sleeve 10 were present. The ID 57 of the outer part 40 may be proportional to the ID 99 of the tubing 17. In one example, the ID 57 of the outer part 40 is 1.920 inches for 2¾ tubing ID 99. The production fluid passages 46 may be dimensioned to reduce cross sectional flow area, but without substantially increasing the pressure drop across the wear bushing 10. Pressure drop can be calculated in order to ascertain suitable dimensions of wear sleeve 10 and production fluid passage 46.

A 2⅜" pump has a maximum pump rate of 40 cubes a day, and at representative production flow rates of 28 L/min, a suitable wear sleeve 10 may cause only a 3 kPa differential drop. At higher, unrealistic pump rates, such as 100 L/minute, a 100 kPa pressure differential may result with the same wear sleeve 10, but such pump rates are not attainable so may be irrelevant. Thus, at production pump rates a pressure drop of 1-10 kPa may be experienced, in some cases more. Pressure drop is a function of cross-sectional area and flute design.

Figure 22:
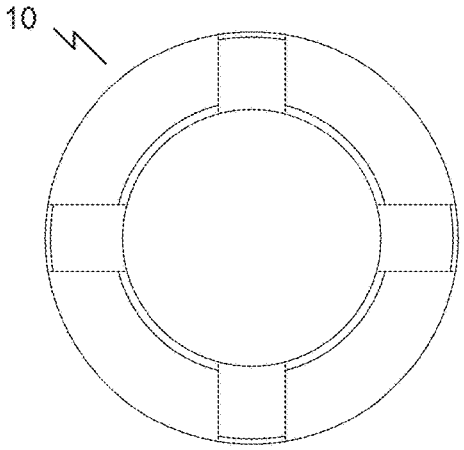
FIGS. 22-24 are an end elevation view, a side elevation section view, and a perspective view, respectively, of a further embodiment of a wear sleeve.
Figure 23:
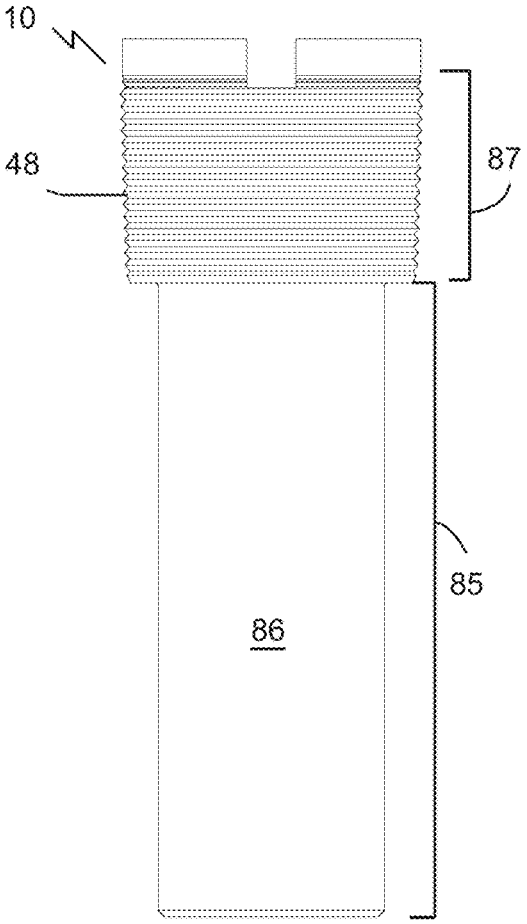
Figure 24:
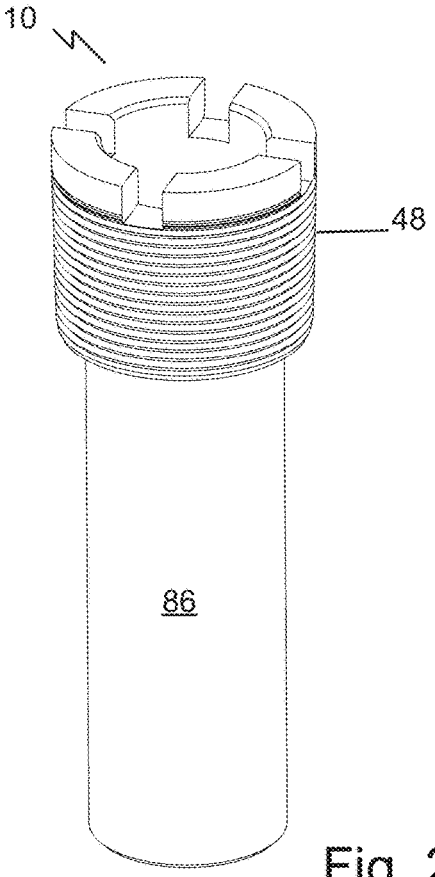

Referring to FIGS. 13-24, four different embodiments of wear sleeves 10 are illustrated. A common difference between the embodiments of FIGS. 13-21 and the embodiment of FIG. 1-12 is that, in the former, the outer and inner parts 40, 42 are integrally formed as a single unit. In such an example, the wear sleeve 10 has a form similar to a Phillips set screw bored through the center. A difference between the embodiments of FIGS. 13-15, 16-18, and 19-21 are the dimensions of the wear sleeve 10. The various embodiments are provided for different tubing hanger sizes. Referring to FIGS. 22-24 another embodiment of a wear sleeve 10 is illustrated with a neck sleeve 86 extended in a downhole direction below the pin threading 48. The neck sleeve 86 may have a length 85 equivalent to one or more times the length 87 of the pin threading 48. The extended neck sleeve 86 may provide additional surface area to contact rod 34 and provide additional centralizing effect on the rod 34.

Referring to FIG. 4, a method is illustrated. At a high level, a wear sleeve 10 is positioned around a polished rod 34 and within a tubing hanger 20 in a production wellhead assembly 12. Once in position, the polished rod 34 may be driven with a reciprocating rod drive such as pump jack 28 to produce oil through the production fluid passage 46.

Installing or positioning the wear sleeve 10 may be done by suitable methods. Several examples will be described, although it should be understood that other suitable methods are within the scope of this document. In an initial stage, the pin threading 48 of outer part 40 is threaded into the uphole facing box threading 50 of the tubing hanger 20.

In a new well that is being completed, the outer part 40 may be threaded into the tubing hanger 20 before the equipment above line A in FIG. 4 is installed, including before the polished rod 34 is installed. Before the wear sleeve 10 is installed, the well may need to be killed by injecting a sufficiently large volume or pad of liquid down the tubing to overcome the reservoir pressure. In addition, in many cases a frac or completion wellhead (not shown) may be installed above line A during the completion stage, and such a wellhead may need to be removed prior to installing the wear sleeve 10.

If the wear sleeves 10 of FIGS. 13-24 are used, once the wear sleeve 10 is threaded in place, the equipment above line A need be installed as if wear sleeve 10 was not present. After the wear sleeve 10 is in place, the pumping wellhead, for example the BOP 29, flow tee 27, and other suitable valving and lines may be installed. The bottom hole pump (BHP, not shown) may be run down the well, along with the sucker rod string 30 and the polished rod 34. The stuffing box 36 may be positioned on the rod 34 before the rod is coupled, for example by coupling 95 to the sucker rod string 30, after which the stuffing box 36 may be secured to the wellhead assembly 12. The fluid pad is removed from the tubing, the polished rod 34 is connected to the bridle 32, and production begins.

If the wear sleeve of FIGS. 1-3 is installed, the initial positioning stage may comprise threading in the outer part 40 with or without the inner part 42 inserted in the outer part 40. If the inner part 42 is not inserted in the outer part 40 at this stage, the inner part 42 may be inserted as follows. After the outer part 40 is threaded into the tubing hanger 20, the BOP 29, flow tee 27, and other suitable valving and lines may be installed. The BHP is run with the sucker rod string 30, and the inner part 42, coupling 95 and stuffing box 36 are positioned on the polished rod 34, with the inner part 42 positioned between the coupling 95 and the stuffing box 36. The polished rod 34 is then inserted into the wellhead 12.

The inner part 42 is installed by applying axial force in a downhole direction, for example by tapping the inner part 42 with a tool, such as a semi-cylinder, until the collet 45 locks. The polished rod 34 is coupled to the sucker rod, and the stuffing box 36 is connected. The inner part 42 may be installed before or after the rod 34 is connected to string 30. In some cases the rod 34 is left sitting on the string 30 while the inner part 42 is installed, following which the rod 34 is connected to string 30. The remaining steps to production may be the same as described above.

Referring to FIG. 4, in order to permit the inner part 42 to pass through the flow tee 27, a maximum OD 92 of the inner part may be equal to or less than a minimum ID (not shown) of the flow manifold 27 and other components such as BOP 29 and bonnet 94 that may be present above line A. Such a dimensional feature also permits the replacement of worn inner parts 42 without requiring removal of the flow tee 27 and equipment above A, with the exception of the stuffing box 36. Tubing hanger box threads 50 are the same size as male and female threads on the flow tee 27, the BOP 29, and the bonnet 94. Thus, the OD 92 of the inner part 42 may be sized smaller than the maximum outer diameter 91 of the pin threading 48.

Replacing the inner part 42 may proceed as follows. In one example, positioning further comprises positioning the inner part 42 of the wear sleeve 10 on the polished rod 34, and inserting the inner part 42 into the outer part 40 of the wear sleeve 10. After the worn inner part 42 is removed, the replacing method may be exactly the same as the installation of a new inner part 42. To remove the inner part, the polished rod 34 is pulled, for example by a servicing rig, in an uphole direction along with coupling 95, after the rod 34 is separated from sucker rod string 30. The coupling 95 will contact the downhole end 62 of the inner part 42, and upon application of sufficient force in an uphole direction will unlock the collet and release the inner part 42 up the well. The worn insert 42 is removed, and a new one installed as per the remainder of the method described above.

The wear sleeves 10 and methods provided in this document do not fix well deviations. Instead such sleeves 10 merely permit prolonged use of a polished rod 34 in such wells without damaging the rod 34 or stuffing box 36.

Directional language such as downhole, uphole, up, top, and bottom are relative terms and are not to be construed as limited to absolute directions defined relative to the direction of gravitational force. The sequence of method steps provided may take a logical order that is not in the order iterated in all cases. Positioning a wear sleeve may mean positioning part of a wear sleeve. The wear sleeve 10 may be provided in a plurality of semi-cylindrical parts that are assembled laterally about a polished rod 34 rather than a sleeve axially inserted around the polished rod 34. The disclosed methods and wear sleeves 10 may be used on oil and gas wells, water wells, and other suitable types of wells.

Connections between components may be direct or indirect through other tools, spools, or parts. Production wellhead assembly 12 includes subsea and surface wellheads, and part of the wellhead assembly 12 may be located below the surface of the ground or seabed. Reciprocating rod drive embodiments include embodiments where no pump jack is used, for example the ROTOFLEX™ unit made by Weatherford. Threading may be pitched and have any suitable threading style, for example EUE, API, and others.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method comprising:

positioning a wear sleeve around a polished rod, the polished rod being solid, the wear sleeve being within a tubing hanger in a production wellhead assembly of a well, with the tubing hanger hanging tubing within the well, and the polished rod connected to a sucker rod that runs through the tubing to a down-hole pump, with the wear sleeve defining a production fluid passage that extends from a downhole end of the wear sleeve to an uphole end of the wear sleeve;

in which an outer part of the wear sleeve has pin threading that is threaded within an uphole facing box threading in an internal bore of the tubing hanger;

driving the polished rod to produce production fluid from below to above the wear sleeve through the production fluid passage; and in which positioning further comprises threading the pin threading of the outer part into the uphole facing box threading of the tubing hanger.

2. The method of claim 1 in which driving further comprises driving the polished rod with a reciprocating rod drive to produce oil through the production fluid passage, in which the production wellhead assembly is mounted to a well whose well bore deviates from vertical at or near the ground surface to an extent sufficient to draw the polished rod to one side within the production wellhead assembly.

3. The method of claim 1 in which the wear sleeve comprises:

an inner part defining a polished rod passage, the inner part comprising sacrificial material.

4. The method of claim 3 in which positioning further comprises inserting the inner part into the outer part.

5. The method of claim 4 in which inserting further comprises seating the outer part within an annular recessed portion defined on an outer surface of the inner part.

6. The method of claim 5 in which inserting further comprises translating a downhole end of the inner part past a downhole end of the outer part, the downhole end of the inner part comprising a plurality of collet fingers defining a downhole shoulder of the annular recessed portion.

7. The method of claim 4 in which positioning further comprises:

positioning the inner part of the wear sleeve on the polished rod; and inserting the inner part into the outer part of the wear sleeve.

8. The method of claim 4 in which the production wellhead assembly comprises, in sequence in an uphole direction, the tubing hanger, a flow manifold, and a stuffing box, in which positioning further comprises:

removing the stuffing box from the flow manifold;

disconnecting the polished rod from a sucker rod string and withdrawing the polished rod from the flow manifold;

positioning the inner part of the wear sleeve on the polished rod;

inserting the polished rod with the inner part of the wear sleeve into the flow manifold;

inserting the inner part into the outer part of the wear sleeve;

connecting the polished rod to the sucker rod string; and connecting the stuffing box to the flow manifold.

9. The method of claim 8 further comprising after disconnecting the polished rod and before inserting the polished rod:

removing the flow manifold to expose the uphole facing box threading of the tubing hanger;

threading the outer part of the wear sleeve into the uphole facing box threading of the tubing hanger; and replacing the flow manifold on the production wellhead assembly.

10. A wear sleeve comprising:

an outer part with pin threading sized to, during use, fit within an uphole facing box threading in an internal bore of a tubing hanger of a production wellhead assembly, the tubing hanger configured to hang tubing below the production wellhead assembly;

an inner part defining a polished rod passage, the inner part comprising sacrificial material;

a keyway slot defined on an uphole facing surface of one or both the outer part and the inner part; and a production fluid passage that is defined in use by one or more of the outer part or the inner part, the production fluid passage comprising a plurality of grooves, in an inner surface of the inner part, extending from a downhole end of the wear sleeve to an uphole end of the wear sleeve in order to permit production fluid to flow through the wear sleeve from below to above the wear sleeve while the wear sleeve is positioned in use around a polished rod.

11. The wear sleeve of claim 10 in which a maximum outer diameter of the wear sleeve is defined by the pin threading of the outer part.

12. The wear sleeve of claim 10 in which the outer part comprises an outer sleeve, the inner part comprises an inner sleeve, and further comprising a lock for securing the inner sleeve within the outer sleeve.

13. The wear sleeve of claim 12 in which the inner sleeve comprises a downhole shoulder and an uphole shoulder spaced along an outer surface of the inner sleeve to define an annular recessed portion sized to seat the outer sleeve.

14. The wear sleeve of claim 13 in which the lock comprises a plurality of collet fingers that define the downhole shoulder.

15. The wear sleeve of claim 14 in which one or more of:

an uphole facing end surface of the downhole shoulder is bevelled; and a downhole facing end surface of the outer sleeve is bevelled.

16. The wear sleeve of claim 10 in which the plurality of grooves comprise spiral grooves.

17. The wear sleeve of claim 10 in which the sacrificial material comprises polytetrafluoroethylene (PTFE).

18. The wear sleeve of claim 10 further comprising a wear indicator.

19. A production wellhead assembly comprising:

a polished rod;

a stuffing box;

a flow manifold;

a blow out preventer;

a tubing hanger;

tubing hanging from the tubing hanger within a well, with the polished rod connected to a sucker rod that runs through the tubing to a down-hole pump; and the wear sleeve of claim 10 positioned around the polished rod and within the tubing hanger.

20. The production wellhead assembly of claim 19 mounted to a well whose well bore deviates from vertical at or near the ground surface to an extent sufficient to draw the polished rod to one side within the production wellhead assembly.

* * * * *